US007241113B2

(12) United States Patent
MacManus

(10) Patent No.: US 7,241,113 B2
(45) Date of Patent: Jul. 10, 2007

(54) VORTICITY CONTROL IN A GAS TURBINE ENGINE

(75) Inventor: David G MacManus, Olney (GB)

(73) Assignee: Rolls-Royce plc, London (GB)

( * ) Notice: Subject to any disclaimer, the term of this patent is extended or adjusted under 35 U.S.C. 154(b) by 210 days.

(21) Appl. No.: 10/983,654

(22) Filed: Nov. 9, 2004

(65) Prior Publication Data

US 2005/0106022 A1 May 19, 2005

(30) Foreign Application Priority Data

Nov. 13, 2003 (GB) ..... 0326575.8

(51) Int. Cl.
*B64C 26/06* (2006.01)
*F01D 5/12* (2006.01)

(52) U.S. Cl. ..... 416/90 R; 416/97 R; 415/115; 244/199.1

(58) Field of Classification Search ..... 416/90 R; 415/10, 191; 244/199.1, 200.1
See application file for complete search history.

(56) References Cited

U.S. PATENT DOCUMENTS

| | | | | |
|---|---|---|---|---|
| 3,039,736 | A * | 6/1962 | Pon | 416/90 R |
| 3,776,363 | A * | 12/1973 | Kuethe | 415/119 |
| 5,503,529 | A * | 4/1996 | Anselmi et al. | 416/90 R |
| 6,004,095 | A * | 12/1999 | Waitz et al. | 416/97 R |
| 2003/0143075 | A1 * | 7/2003 | Fleck | 416/97 R |

* cited by examiner

*Primary Examiner*—Richard A. Edgar
(74) *Attorney, Agent, or Firm*—W. Warren Taltavull; Manelli Denison & Selter PLLC

(57) ABSTRACT

An arrangement for reducing vorticity downstream of a turbine nozzle guide vane 34 in a gas turbine engine. The arrangement including directing cooling air through the guide vane 34 and out through outlets 40 in directions to counteract the wave vorticity produced downstream of the guide vane 34.

10 Claims, 5 Drawing Sheets

VORTICITY CONTROL IN A GAS TURBINE ENGINE

FIELD OF THE INVENTION

This invention relates to an arrangement for reducing vorticity in a gas turbine engine, a component for a gas turbine engine, and a turbine for a gas turbine engine.

BACKGROUND OF THE INVENTION

In gas turbine engines a wake is produced downstream of components past which gases flow, and especially components which turn the direction of the gas flow. This wake may roll up into a discrete vortex of intense vorticity that can result in significant flow distortions as well as mixing and interference losses downstream thereof. Such components include turbine aerofoils, and the wake produced downstream thereof can have an effect upon subsequent blade rows where it results in flow distortions, incidence and other loss mechanisms.

SUMMARY OF THE INVENTION

According to the present invention there is provided an arrangement for reducing vorticity downstream of a component in the gas flow of a gas turbine engine, the arrangement including means for introducing a gas into the gas flow in a direction or directions to counteract the wake vorticity produced downstream of the component.

Means are preferably provided for introducing the introduced gas through the component.

The arrangement may be configured such that the introduced gas is air, and may be cooling air which has already passed through the component.

Guide means may be provided which are arranged to direct the introduced gas at an inclination relative to the gas flow. The guide means may include slots or openings, and openings may be directed onto guide formations to provide the required inclination.

The guide means may be arranged to directly introduce gas in different directions from different parts of the component. The guide means may be arranged to direct the introduced gas in different directions from different sides of the component.

The guide means may be arranged to swirl the introduced gas in a manner which results in vorticity with an opposite sign to that of the wake vorticity, and the guide means may include passages with vanes, grooves, fences, rifling or other formations on the walls thereof to cause swirling.

The component may include an aerofoil, which component may form part of a compressor or turbine, and in particular the component may be a turbine nozzle guide vane.

The invention also provides a component for a gas turbine engine, the component being according to any of the preceding seven paragraphs.

The component may be a turbine nozzle guide vane.

The invention yet further provides a turbine for a gas turbine engine, the turbine including a plurality of components according to any of the preceding nine paragraphs.

The invention still further provides a method of reducing wake vorticity downstream of a component in the gas flow in a gas turbine engine, the method including introducing a gas in a direction or directions to counteract the wake vorticity produced downstream of a component.

The gas may be introduced through the component.

The introduced gas may be directed in different directions from different parts of the component.

The introduced gas may be swirled to result in a vorticity with an opposite sign to that of the wake vorticity.

BRIEF DESCRIPTION OF THE DRAWINGS

Embodiments of the present invention will now be described by way of example only and with reference to the accompanying drawings, in which.

DETAILED DESCRIPTION OF THE INVENTION

Figure 1:
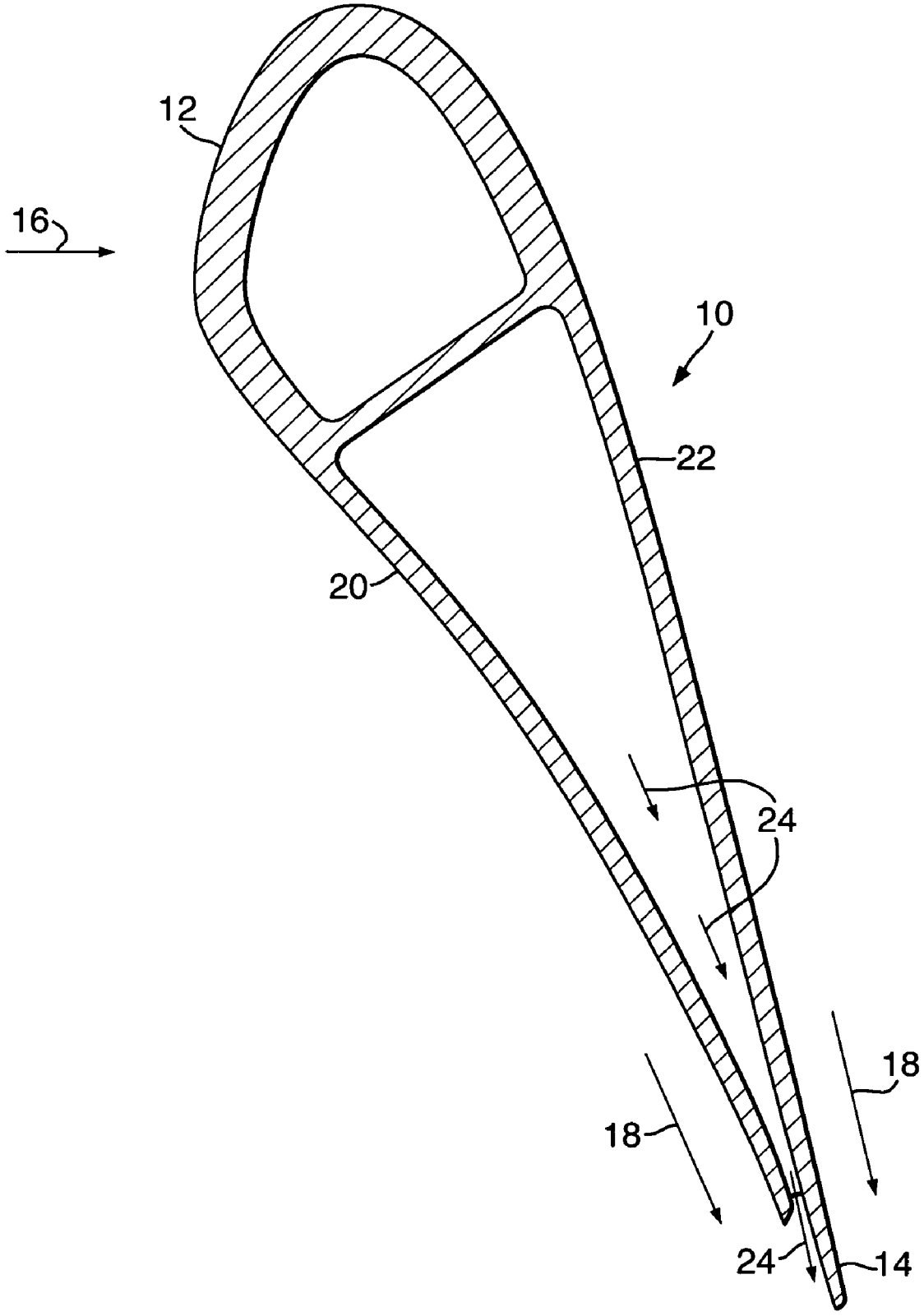
FIG. 1 is a diagrammatic cross sectional view through a conventional turbine nozzle guide vane of a gas turbine engine.

FIG. 1 shows a conventional turbine nozzle guide vane 10 with a leading edge 12 and a trailing edge 14. The inlet gas flow direction is shown by the arrow 16 and this gas flow is turned by the guide vane 10 to the direction shown by the arrows 18. The shape of the guide vane 10 produces a pressure side 20 and a suction side 22. As is conventional air cooling is provided through the nozzle guide vane 10 as illustrated by the arrows 24, and some cooling air may exit the guide vane 10 at the trailing edge 14.

Figure 2:
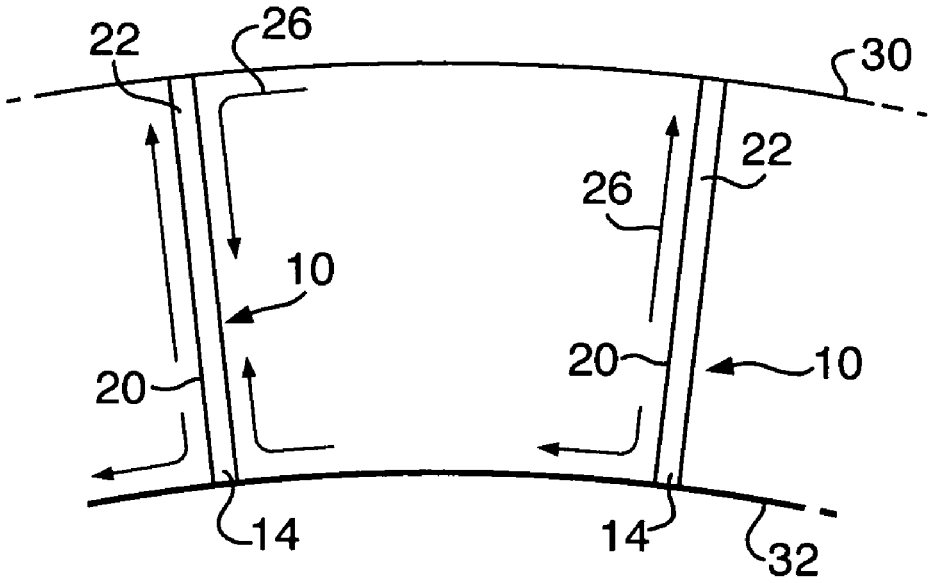
FIG. 2 is a diagrammatic axial section view through part of a conventional turbine looking upstream.
Figure 3:
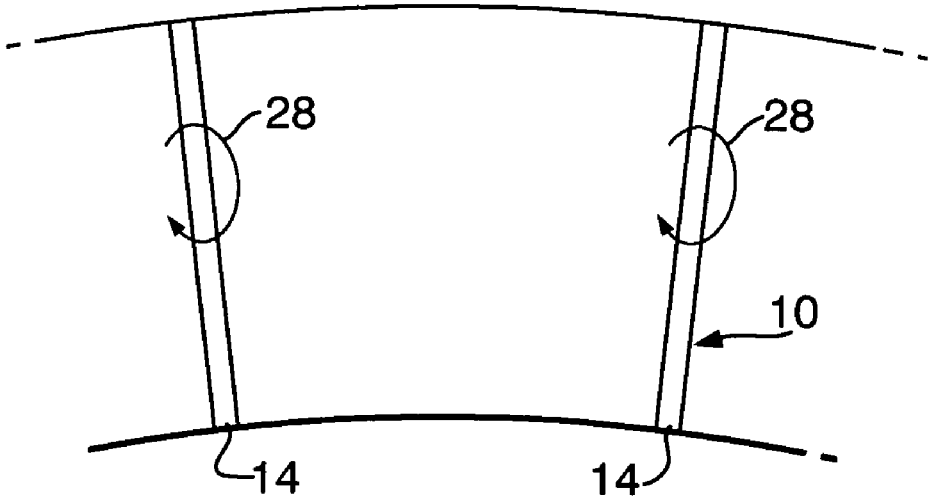
FIG. 3 is a similar view to FIG. 2 but with other indications provided.

FIGS. 2 and 3 diagrammatically show two such nozzle guide vanes 10 looking upstream with their suction sides 22 and pressure sides 20. Arrows 26 in FIG. 2 illustrate how the gas flow may tend to pitch down on the suction side 22 whilst pitching up on the pressure side 20. FIG. 3 indicates by arrows 28 an example of the induced negative streamwise vorticity. In FIGS. 2 and 3 the guide vanes 10 are seen extending between the casing 30 and the hub 32.

Figure 4:
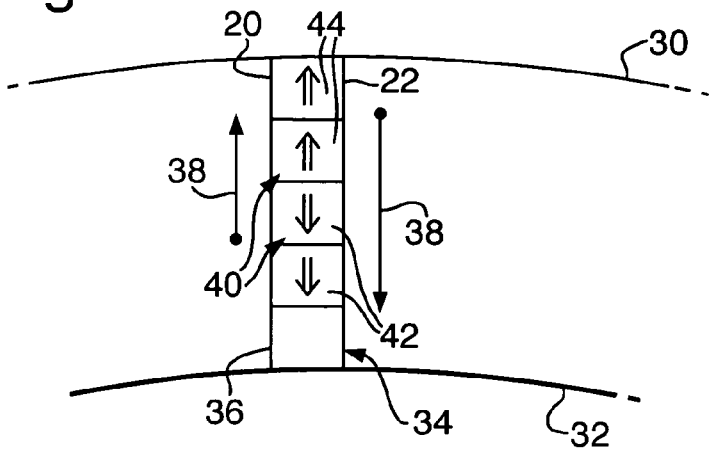
FIG. 4 is a diagrammatic axial section view through part of a first gas turbine according to the invention looking upstream.

FIG. 4 shows a first arrangement according to the invention with a nozzle guide vane 34 extending between the casing 30 and hub 32. Again the view is upstream so the trailing edge 36 is visible with the pressure side 20 and suction side 22. Arrows 38 illustrate the main flow pitching down on the suction side 22 and pitching up on the pressure side 20. The trailing edge 36 is shown schematically to have four outlets 40 for cooling air passing through the nozzle guide vane 34. The lower two outlets 42 are directed downwardly as shown by the arrows illustrated therein whilst the upper two outlets 44 are directed upwardly again as illustrated by the arrows shown therein. The inclination and arrangement of the outlets 40 is chosen to, result in reduced streamwise vorticity in the wake of the guide vane 34.

Figure 5:
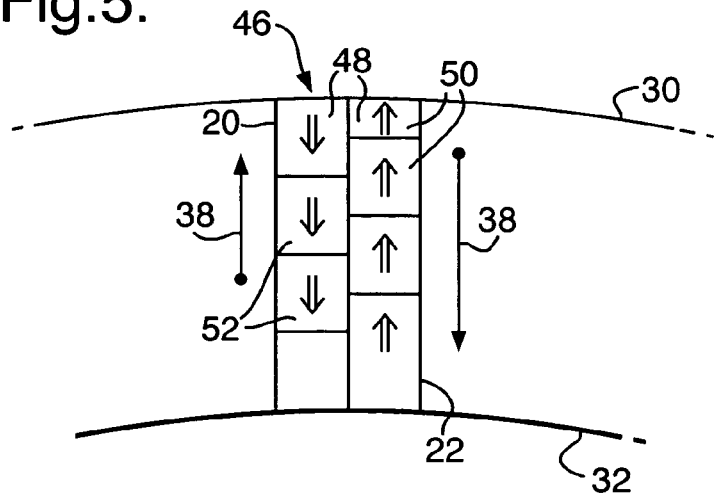
FIG. 5 is a similar view to FIG. 4 of a second gas turbine according to the invention.
Figure 6:
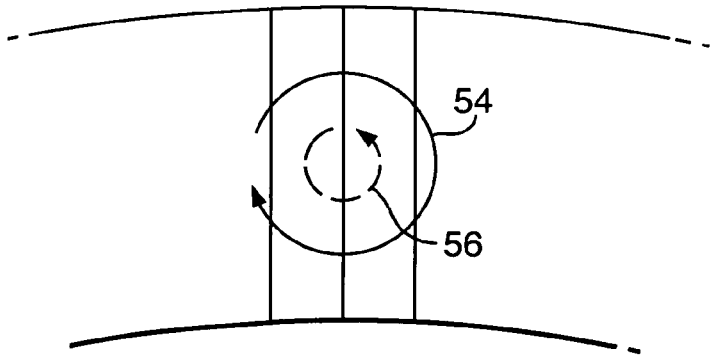
FIG. 6 is a similar view to FIG. 5 but with other markings thereon.

FIGS. 5 and 6 show a second embodiment with a turbine nozzle guide vane 46 again extending between the casing 30 and hub 32. In this instance seven outlets 48 are schematically shown. Four upwardly inclined outlets 50 are provided on the suction side 22, whilst three offset downwardly inclined outlets 52 are provided on the pressure side 20. FIG. 6 illustrates the main stream induced negative vorticity by the arrow 54, whilst the arrow 56 illustrates the positive vorticity induced by the cooling air through the outlets 48.

Whilst in this example the outlets 50 and 52 are offset, it is not always necessary to provide an offset configuration.

Figure 7:
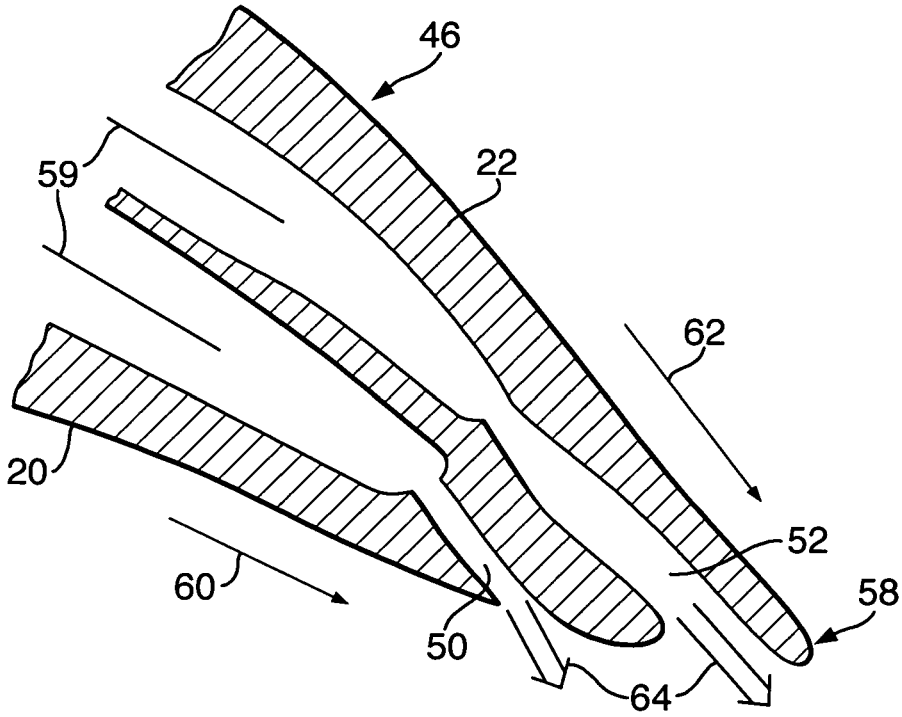
FIG. 7 is a diagrammatic cross sectional view through part of a component of the second gas turbine.

FIG. 7 illustrates the trailing edge 58 of the nozzle guide vane 46. Coolant supply chambers 59, which may be shared or separate, for the cooling air passing through the nozzle guide vane 46 are shown leading to outlets 50, 52, with the outlets 50 angled down and the outlets 52 angled up. The freestream flow pitching up is shown by the arrow 60 on the pressure side 20, with the freestream flow pitching down illustrated by the arrow 62 on the suction side 22. The flow of cooling air is illustrated by the arrows 64.

Figure 10:
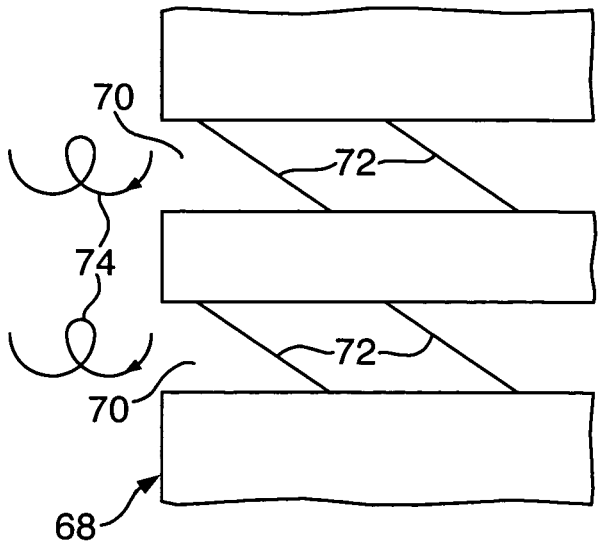
FIGS. 9 and 10 are respectively views in the direction of the lines A—A and B—B illustrated in FIG. 8.
Figure 8:
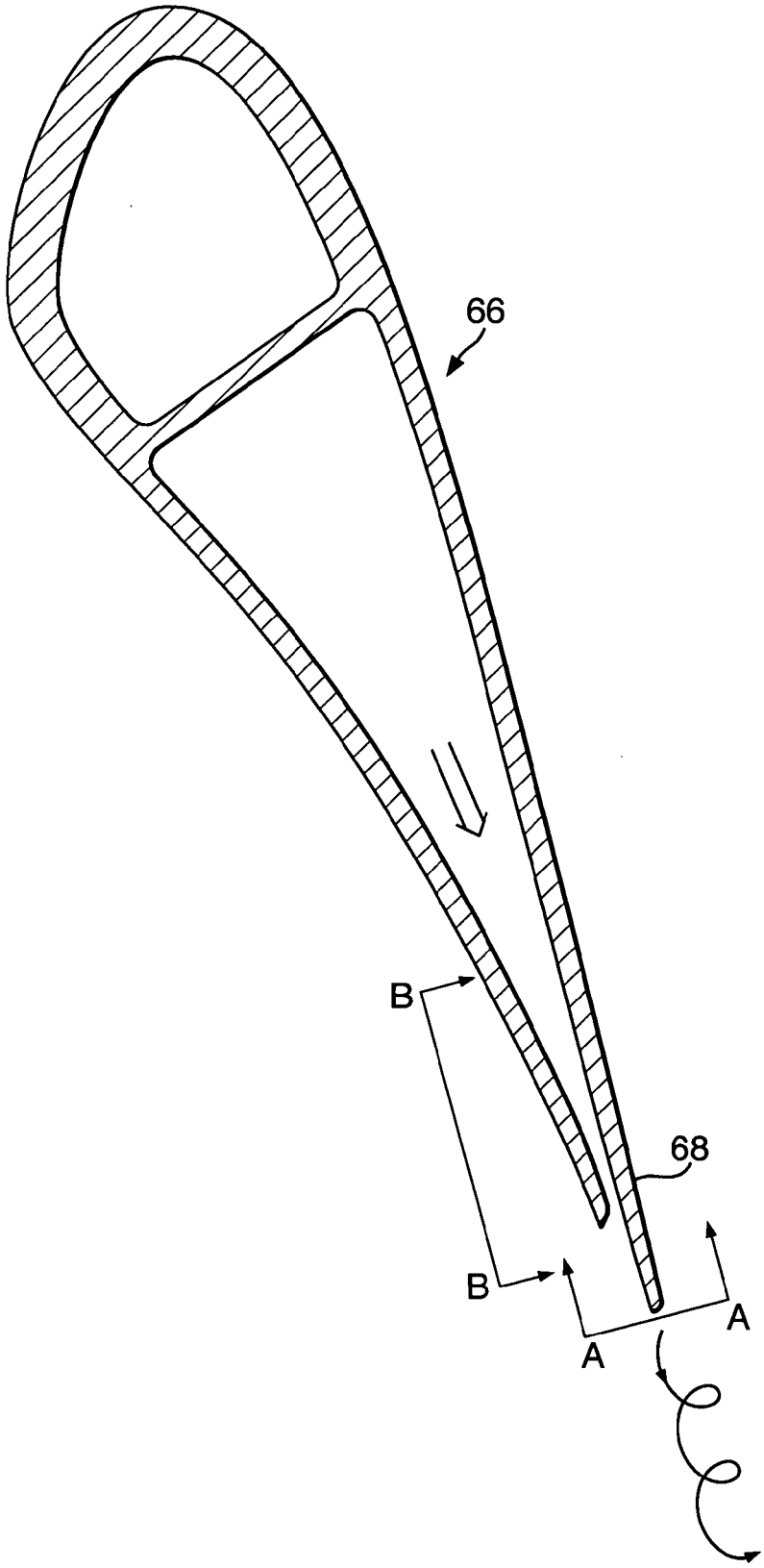
FIG. 8 is a similar view to FIG. 1 but of a turbine nozzle guide vane according to a third embodiment of the invention.
Figure 9:
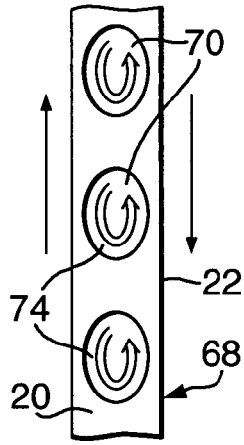

FIGS. 8 to 10 illustrate a further turbine nozzle guide vane 66 which again ejects cooling air through its trailing edge 68. A plurality of passages 70 are provided in the trailing edge 68 for ejection of cooling air. Helical fences 72 are provided in the passages 70 to swirl cooling air passing therethrough as illustrated by the arrows 74 which show a positive induced vorticity to counteract the main flow pitching down on the suction side 22 and pitching up on the pressure side 20. Whilst helical fences 72 have been described, the swirling of the cooling air can be produced by a number of other means such as rifling, grooves or vanes.

There are thus described various arrangements for counteracting the wake vorticity produced behind turbine nozzle guide vanes. The reduction of this vorticity provides for a number of advantages. These include increased performance, due to the reduction of efficiency losses such as mixing, flow distortions and downstream incidence effects. In addition, aerodynamic unsteady forcing contributing to fatigue failure of downstream components is also reduced.

Various other modifications may be made without departing from the scope of the invention. For instance, the ejection of the cooling air could be in a number of different directions, and could extend at least to some degree laterally to counteract the vorticity. Obviously any required combination of inclinations and number of cooling air ejectors can be chosen. These ejectors can be nozzles or could for example be openings directed onto a profiled member. Whilst the use of cooling air has only been described, it may be possible for air other than cooling air or other gases to be used to counteract the vorticity. This would obviously be of particular relevance to uncooled components.

Whilst the invention has been described in terms of nozzle guide vanes for turbines, the invention could be applicable to a wide range of products located in the gas stream, and particularly products which turn the gas stream. Such products include for instance compressor guide vanes.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An arrangement for reducing vorticity downstream of a component in a gas flow of a gas turbine engine, the arrangement including means for introducing a gas into the gas flow in at least one direction to counteract the wake vorticity produced downstream of the component wherein means are provided for introducing the introduced gas through the component.

2. An arrangement according to claim 1, wherein the arrangement in configured such that the introduced gas is cooling air which has already passed through the component.

3. An arrangement according to claim 1, wherein guide means are provided which are arranged to direct the introduced gas at an inclination relative to the gas flow.

4. An arrangement according to claim 1 wherein the component includes an aerofoil, which component forms part of one of a compressor and turbine.

5. An component according to claim 1, wherein the component is a turbine nozzle guide vane.

6. An arrangement for reducing vorticity downstream of a component in a gas flow of a gas turbine engine, the arrangement including means for introducing a gas into the gas flow in at least one direction to counteract the wake vorticity produced downstream of the component wherein guide means are provided which are arranged to direct the introduced gas at an inclination relative to the gas flow and to directly introduce gas in different directions from different parts of the component, and from different sides of the component wherein means are provided for introducing the introduced gas through the component.

7. An arrangement for reducing vorticity downstream of a component in a gas flow of a gas turbine engine, the arrangement including means for introducing a gas into the gas flow in at least one direction to counteract the wake vorticity produced downstream of the component wherein guide means are provided which are arranged to direct the introduced gas at an inclination relative to the gas flow and to swirl the introduced gas in a manner which results in vorticity with an opposite sign to that of the wake vorticity wherein the guide means include passages with formations on the walls thereof to cause swirling.

8. A method of reducing wake vorticity downstream of a component in the gas flow in a gas turbine engine the method including introducing a gas in at least one direction to counteract the wake vorticity produced downstream of a component wherein the gas is introduced through the component.

9. A method according to claim 8, wherein the introduced gas is directed in different directions from different parts of the component.

10. A method according to claim 8, wherein the introduced gas is swirled to result in a vorticity with an opposite sign to that of the wake vorticity.

* * * * *